US005978990A

United States Patent [19]

Akey

[11] Patent Number: 5,978,990

[45] Date of Patent: Nov. 9, 1999

[54] COMFORT MATERNITY PILLOW

[76] Inventor: Zhanna Akey, 38 Chelsea Pl., Williston, Vt. 05495

[21] Appl. No.: 09/289,356

[22] Filed: Apr. 9, 1999

Related U.S. Application Data

[60] Provisional application No. 60/082,460, Apr. 20, 1998.

[51] Int. Cl.[6] ..... A47G 9/00; A47C 27/00

[52] U.S. Cl. ..... 5/632; 5/631; 5/930; D6/598

[58] Field of Search ..... 5/632, 631, 630, 5/636, 640, 644, 930; D6/601, 599, 598, 597

[56] References Cited

U.S. PATENT DOCUMENTS

| | | | |
|---|---|---|---|
| D. 174,996 | 6/1955 | Peters | D6/598 |
| D. 337,683 | 7/1993 | Bowyer | D6/601 |
| D. 408,675 | 4/1999 | Lewis et al. | D6/598 |
| 2,795,802 | 6/1957 | Myers | 5/632 |
| 4,173,048 | 11/1979 | Varaney | 5/632 |
| 5,026,315 | 6/1991 | Chap | 5/636 |
| 5,027,457 | 7/1991 | Sweet | 5/490 |

FOREIGN PATENT DOCUMENTS

| | | | |
|---|---|---|---|
| 127058 | 1/1950 | Sweden | 5/640 |

*Primary Examiner*—Alexander Grosz
*Attorney, Agent, or Firm*—Zhanna G. Akey

[57] ABSTRACT

Comfort Maternity Pillow allows pregnant women to rest or sleep in any desirable position at any stage of their pregnancy without disturbing their previous resting habits. The object of this invention comprises a rectangular pillow that has two attached extensions. The detachable pillow extensions are uniquely curved to form an open cavity when placed together. This allows a pregnant female to rest or sleep on her expanding abdomen in prone position. When the above said pillow extensions are pulled away from each other, they function in assisting a pregnant woman who is resting in side position. In this scenerio, one pillow extension supports a woman's back, and another extension, supports her abdomen and legs, when placed between her knees. Comfort Maternity Pillow aides pregnant women with many other positions by means of manipulating the pillow extensions.

5 Claims, 4 Drawing Sheets

COMFORT MATERNITY PILLOW

This application claims the benefit of provisional application Ser. No. 60/082,460 filed Apr. 20, 1998.

BACKGROUND

1. Field of Invention

This invention relates to the pillow for use by women who are pregnant.

2. Description of Prior Art

There are currently a number of pillows specifically designed for pregnant women to aide in relieving the stress involved in basic activities such as resting and sleeping. Although these devices do fulfill their function in a limited manner, the complexity of their operation disrupts a natural resting or sleeping pattern that the woman is used to. For example, pregnancy devices that use any kind of mechanical apparatus necessary to operate for pose adjustment, such as hand air pumps or buttons for electrical operation (such as inventions with U.S. Pat. No. 4,984,315 issued to Ortman (1991) or U.S. Pat. No. 5,425,147 issued to Supplee (1995) and others in this category), interfere with natural resting or sleeping habits. All of these devices that allow pregnant woman to rest or sleep in any desirable position at any stage of her pregnancy require complicated steps, as described above, for a specific pose adjustment. The devices that demonstrate their simplicity in its operation (such as U.S. patent issued to Gambin (1993) that uses the idea of a hole in a middle of the pillow to assist pregnant women to rest or sleep in prone position or U.S. Pat. No. 4,506,396 issued in 1985, which is an improvement to U.S. Pat. No. 2,562,725, issued in 1951, employs an idea of using connected pillows to support pregnant abdomen in prone position but unable to do its function for the end-stage pregnancy size abdomen) are limited for use to a specific pose or a specific stage of pregnancy.

SUMMARY OF THE INVENTION

The object of this invention is to provide a light weight pillow that is adjustable to any desirable position at any stage of pregnancy and doesn't disrupt any previous resting or sleeping habits nor does it require the use of any specific mechanism to operate such pillow.

The present invention comprises a basic common-use rectangular pillow that has two extensions that are curved towards each other on the bottom to create an open cavity for the pregnant abdomen. The said extensions are attached to the rectangular pillow by means of a string. Both extensions and the pillow are made of a soft fabric and filled with polyfil material. The Comfort Maternity Pillow is used by a pregnant woman to rest in any possible position by simply pushing in or out the pillow extensions: in prone position, the extensions would need to be pushed towards each other to its maximum to create an open cavity for a pregnant abdomen; to rest or sleep on her side, a woman needs to position her body so that one extension will "hug" her back, thus providing a comfortable back support, and another extension will "hug" her abdomen while the curvature of that extension is placed between the knees, providing additional relief to her discomforts relating to pregnancy. One of the advantages of present invention is that at any point during her rest a pregnant woman can decide not to use the pillow extensions without making any effort nor feeling the necessity to rearrange her resting or sleeping station.

BRIEF DRAWING DESCRIPTION

FIG. 1 Comfort Maternity Pillow as shown is positioned to allow pregnant women to rest or sleep in prone position.

FIG. 1*a* Comfort Maternity Pillow as shown is positioned to allow pregnant women to rest or sleep on their side, or in case if pillow extensions are not used.

FIG. 2*a* Shows left Pillow Extension.

FIG. 2*b* Shows right Pillow Extension.

FIG. 2*c* Shows a main rectangular pillow.

FIG. 3*a* Shows Comfort Maternity Pillow when the rectangular pillow is substituted with a different pillow that is shaped to resemble an elephant's head. This Comfort Maternity Pillow, with its rectangular pillow being substituted, is called Comfi-elephant.

FIG. 3*b* Shows Comfi-elephant's main pillow in detail.

FIG. 4*a* Shows how Comfort Maternity Pillow can be used by pregnant women to rest or sleep on their side.

FIG. 4*b* Shows how Comfort Maternity Pillow can assist pregnant women to rest or sleep on their abdomens in prone position.

1 Main Pillow
2 Right Pillow Extension
3 Left Pillow Extension
4*a* Left Extension String
4*b* Right Extension String
5*a* left Main Pillow (or Comfi-elephant's Head) String
5*b* Right Main Pillow (or Comfi-elephant's Head) String
6 Comfi-elephant's Head
7 Comfi-elephant's Ears

DETAILED DESCRIPTION OF THE INVENTION

Figure 1:
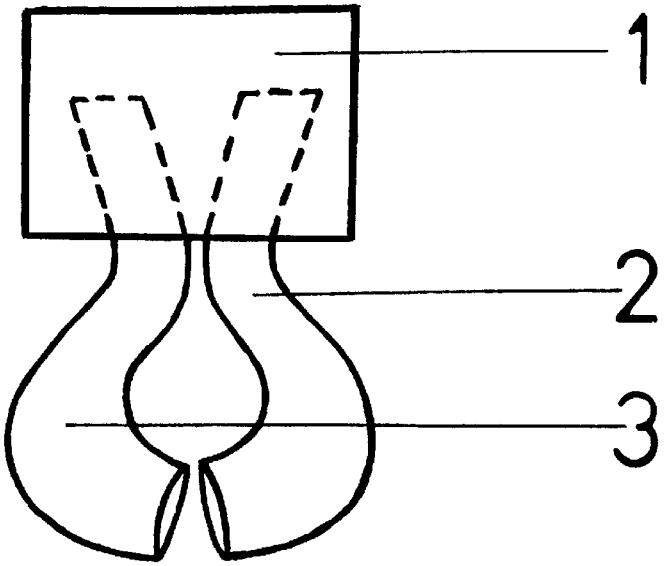
Figure 2A:
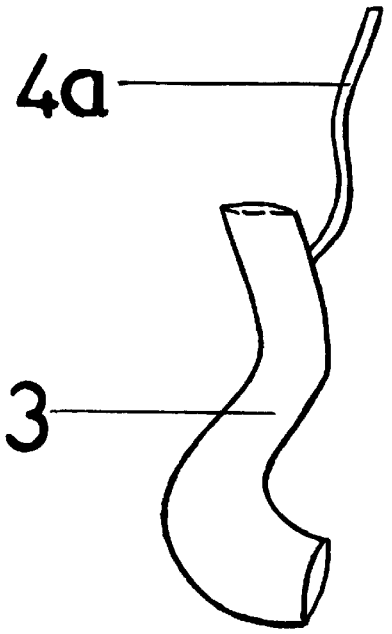
Figure 2B:
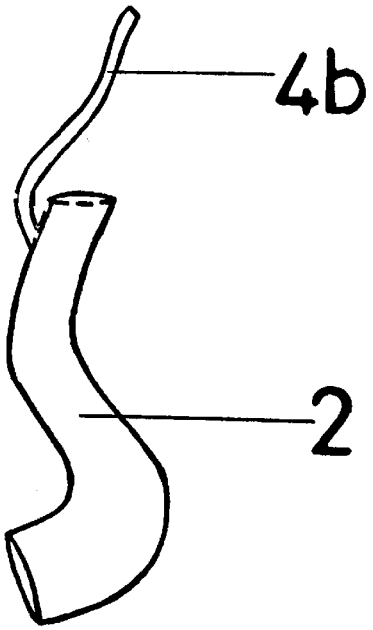
Figure 2C:
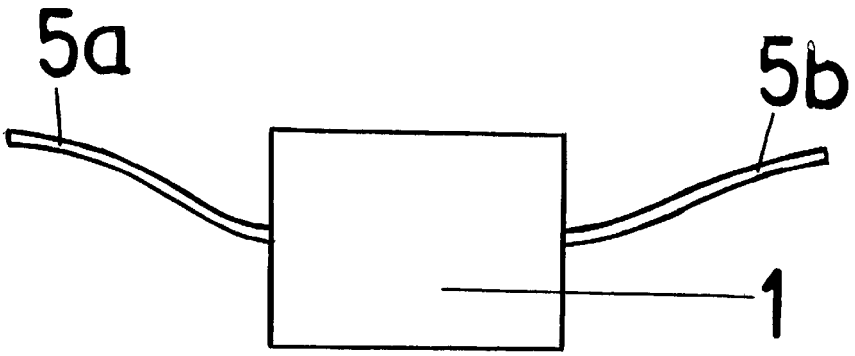

A typical embodiment of the present invention is illustrated on FIG. 1 (normal top view). The main rectangular pillow 1 is attached to two extensions 2,3 that are curved towards each other, thus creating an open cavity to place a pregnant abdomen, while the lower part of the curvature of each extension supports the lower body of a pregnant female. The left extension shown on FIG. 2*a* and the right extension shown on FIG. 2*b* can be connected to the main pillow 1 shown on FIG. 2*c* by means of tying the attached strings 4*a*,4*b*,5*a*,5*b*. This feature, that all parts are detachable, is very convenient in order to be able to wash the Comfort Maternity Pillow in home circumstances. The exterior of the Comfort Maternity Pillow is just a soft fabric covering, the interior contains a polyfil material which is distributed more densely throughout the pillow extensions 2,3 to provide a firm total body support, and less densely in the main pillow 1 to provide a soft comfortable support for head and neck.

Since the pillow extensions 2,3 are freely movable, one size of Comfort Maternity Pillow will fit any pregnant woman. The width of the individual pregnant abdomen is accommodated by pushing the pillow extensions further apart (for wider abdomens) and closer towards each other (for not as wide abdomens). The depth of the open cavity depends also on the positioning of pillow extensions, since, when a pregnant woman is laying in prone and she is supported only by the lower curvature of pillow extensions, then the open cavity is at its maximum depth; but if a pregnant woman, while still in prone position, positions the pillow extensions in such way so that her abdomen is supported by the upper side of the extensions as well as their lower curvature, the depth of the open cavity will decrease, thus accommodating women who are in early stages of pregnancy or simply are of a smaller size. The individual height can be accommodated by the fact that the strings 4*a*,4*b*,5*a*,5*b* can be tied further apart, allowing the main pillow 1 to be moved higher for taller women.

Figure 4A:
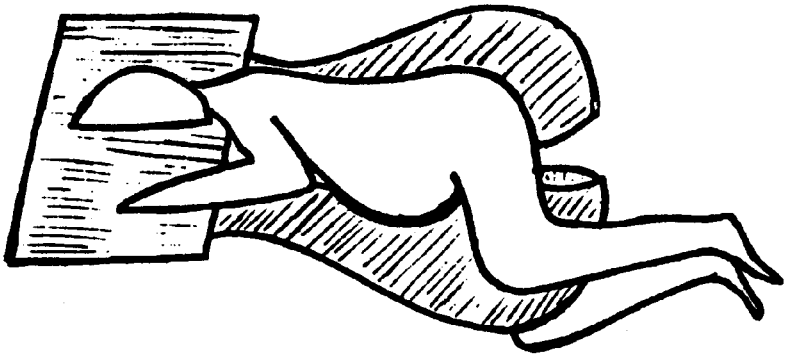
Figure 4B:
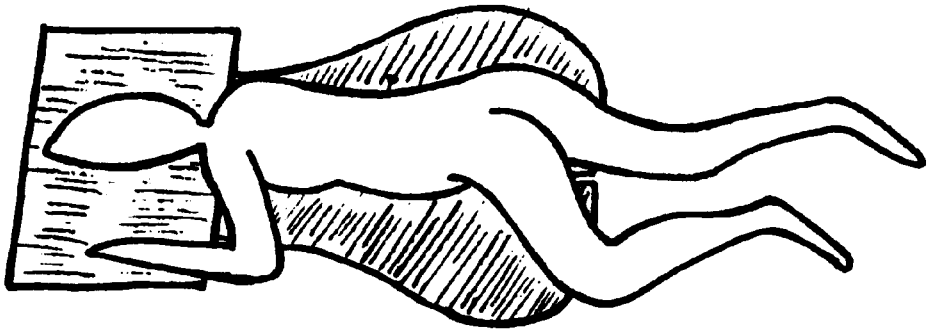

FIG. 4*b* demonstrates a pregnant woman using Comfort Maternity Pillow to rest in prone position.

Figure 1A:
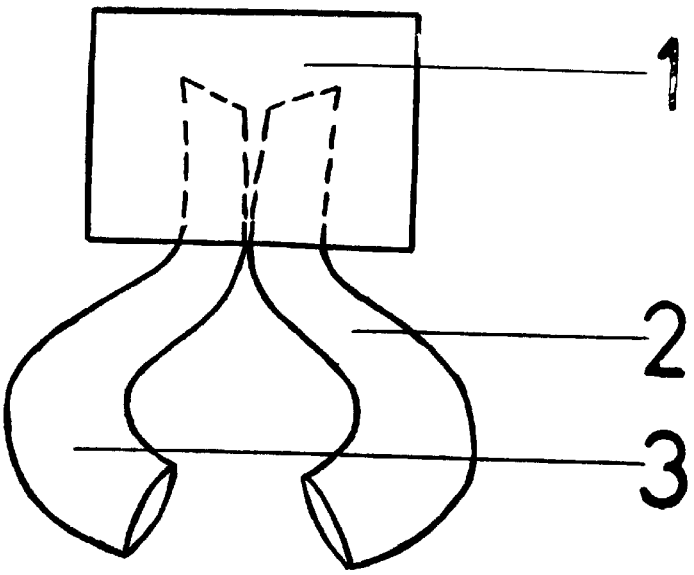

FIG. 1*a* shows Comfort Maternity Pillow when the pillow extensions 2,3 are pushed away from each other so that a woman during her pregnancy will have extra support while resting on her side. The extra support is available when a pregnant female places herself between the pillow extensions 2,3 , and, one pillow extension supports her back while another pillow extension supports her abdomen and knees as demonstrated on FIG. 4*a*. In this position, Comfort Maternity Pillow allows pregnant women to eliminate the use of multiple individual rectangular pillows that are often suggested by caregivers to ease the resting discomforts during pregnancy.

Comfort Maternity Pillow allows pregnant women to rest in many other positions maximizing their resting comfort simply by manipulating the position of pillow extensions. One example is sleeping on the back position, where the pillow extensions are slightly lowered so that a woman's bottom was inside the open cavity and the bottom curvature of both extensions provided her with an elevated leg support. This is accomplished when the main pillow 1 is tied further away from its extensions.

Figure 3A:
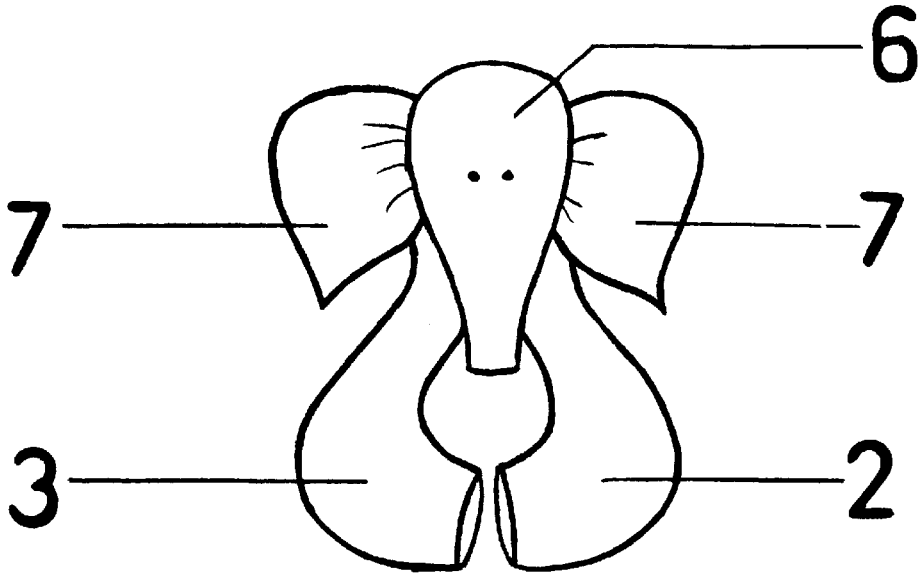
Figure 3B:
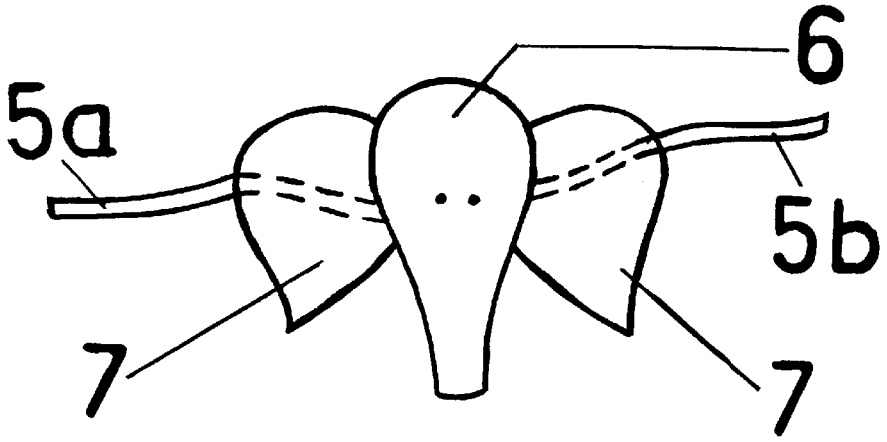

FIG. 3*a* shows that the main pillow 1 can be substituted with a different main pillow design such as to resemble an elephant's head as demonstrated in detail on FIG. 3*b*. This substitution will allow Comfort Maternity Pillow to still serve the same function for pregnant women, and also, it will be more attractive to the children since it will resemble a stuffed toy elephant that was named by the innovator as Comfi-elephant. This demonstrates that the use of Comfort Maternity Pillow is not limited to use during pregnancy only, but also much beyond the pregnancy.

Since the novelty of this invention is in a design of the pillow extensions that are attached to the main pillow, it should be apparent that many modifications could be made to the Comfort Maternity Pillow which would still be encompassed within the spirit of the present invention. It is intended that all such modifications may fall within the scope of the appended claims.

What is claimed is:

1. A pillow adapted to be used by a pregnant woman comprising a main pillow portion adapted to support the upper body portions of a pregnant woman, and two curved, elongated extension portions movably attached to the main pillow portion, each of the extension portions having a shape in the form of an up-side-down question mark relative to the main pillow portion, the extension portions adapted to define, between them, an open cavity portion that is adapted to accommodate the abdomen of a pregnant woman.

2. The pillow of claim 1, wherein the extension portions are releasably attached to the main portion.

3. The pillow of claim 1, wherein the extension portions are permanently attached to the main portion.

4. The pillow of claim 1, wherein the pillow is decorated to resemble a stuffed toy animal.

5. The pillow of claim 1, wherein the pillow is inflatable.

* * * * *